US008246496B2

(12) United States Patent
Holland et al.

(10) Patent No.: US 8,246,496 B2
(45) Date of Patent: Aug. 21, 2012

(54) SPORTS NET AND GOAL APPARATUS

(75) Inventors: Allen Holland, Sheffield (GB); William Parsons, Sheffield (GB)

(73) Assignee: Quick Play Sport Limited, Sheffield (GB)

( * ) Notice: Subject to any disclaimer, the term of this patent is extended or adjusted under 35 U.S.C. 154(b) by 130 days.

(21) Appl. No.: 12/599,845

(22) PCT Filed: May 15, 2008

(86) PCT No.: PCT/GB2008/050352

§ 371 (c)(1),
(2), (4) Date: Apr. 26, 2010

(87) PCT Pub. No.: WO2008/139230

PCT Pub. Date: Nov. 20, 2008

(65) Prior Publication Data

US 2010/0304902 A1 Dec. 2, 2010

(30) Foreign Application Priority Data

May 15, 2007 (GB) ..... 0709292.7

(51) Int. Cl.
*A63B 63/00* (2006.01)

(52) U.S. Cl. ..... 473/478; 273/400

(58) Field of Classification Search ..... 273/398–402, 273/395, 396; 473/434, 435, 454, 456, 476–478
See application file for complete search history.

(56) References Cited

U.S. PATENT DOCUMENTS 4,274,632 A * 6/1981 Jacobs ..... 473/492
5,217,230 A * 6/1993 Judd ..... 473/416
5,344,157 A 9/1994 McCord
5,421,586 A * 6/1995 Amram et al. ..... 273/400
5,562,288 A 10/1996 Erkebaev
5,690,339 A 11/1997 Chen
5,725,444 A * 3/1998 Heden ..... 473/446
5,810,363 A * 9/1998 Saunders et al. ..... 273/407
5,816,956 A * 10/1998 Ellis et al. ..... 473/490
6,511,390 B2 * 1/2003 Kim ..... 473/446
6,517,444 B1 * 2/2003 Yoon ..... 473/197

(Continued)

FOREIGN PATENT DOCUMENTS

DE 10352871 6/2005

OTHER PUBLICATIONS

International Search Report issued in related International Application PCT/GB2008/050352.

Communication pursuant to Article 94(3) EPC dated Sep. 13, 2010 in Application No. 08 737 268.6-1260.

*Primary Examiner* — Mark Graham

(74) *Attorney, Agent, or Firm* — Perkins Coie LLP; Kenneth H. Ohriner

(57) ABSTRACT

A portable sports goal comprising a frame, a first pliable goalpost member, a second pliable goalpost member and a pliable crossbar member. The frame presents net connection points and is configured to support each of the pliable goal members in tension between two net connection points such that the goal apparatus presents a substantially rectangular goal mouth. A frame for use in the goal apparatus. A net for use in the goal apparatus comprising first, second and third edges, and a first pliable goalpost member, a second pliable goalpost member and a pliable crossbar member extending along the first, second and third edge respectively. A method of providing a goal. A portable football goal.

12 Claims, 12 Drawing Sheets

U.S. PATENT DOCUMENTS 6,793,594 B1 * 9/2004 Grant ..... 473/476
6,966,852 B2 * 11/2005 Yoon ..... 473/421
7,270,608 B2 * 9/2007 Cho ..... 473/197
7,744,089 B2 * 6/2010 Huang ..... 273/400
2005/0067785 A1 3/2005 Moore, III
2005/0227794 A1 * 10/2005 Bouffard et al. ..... 473/478
2006/0226607 A1 * 10/2006 Chen ..... 273/407
2009/0197707 A1 * 8/2009 Cho ..... 473/422

* cited by examiner 1210
1201
1202
1203
X
Y
Z

SPORTS NET AND GOAL APPARATUS

BACKGROUND OF THE INVENTION

The present invention relates to goal apparatus, in particular a portable goal apparatus comprising a frame and first and second flexible goal post members and a flexible crossbar member that are releasably connectable to the frame.

Many sports such as football (soccer), hockey etc. utilise a structure having parallel posts and a crossbar to define a goal area. Such structures are usually permanent or semi permanent fixtures and are made from steel or other heavy and cumbersome materials. However, it is also known to provide portable goals that may be assembled on site prior to use and disassembled once use has ceased. In this manner, a location need not be permanently devoted to use as a sports field. Portable goals are particularly useful in training scenarios where it may be beneficial to have a large number of goals to train with, which can then be dismantled after use.

Portable goals known in the prior art often involve the use of tubular plastic materials to form the posts and cross bar which, while representing a saving on weight, are still very bulky when disassembled and therefore represent a significant problem with regard to carrying and storage.

It is an aim of aspects of the present invention to address the above mentioned or other problems.

BRIEF SUMMARY OF THE INVENTION

According to a first aspect of the present invention, there is provided goal apparatus, comprising: a frame, and a first pliable goalpost member, a second pliable goalpost member and a pliable crossbar member; said frame presents a first lower net connection point and a first upper net connection point, and a second lower net connection point and a second upper connection point; and said frame is configured to: support said first pliable goalpost member in tension between said first lower net connection point and said first upper net connection point, support said second pliable goalpost member in tension between said lower net connection point and said second upper net connection point, and support said pliable crossbar member in tension between said first upper net connection point and said second upper net connection point; such that said first and second pliable goalpost members extend substantially parallel to each other and said pliable crossbar member extends substantially perpendicularly to said first and second pliable goalpost members.

According to a second aspect of the present invention, there is provided a frame for use in the goal apparatus, comprising: a base member for resting on a support surface, and first and second post members; wherein said base member presents first and second lower net connection elements, said first and second post members present first and second upper net connection elements respectively, and said first and second upper net connection elements are normally biased apart from a position at which the frame is placed in compression.

According to a third aspect of the present invention, there is provided a net for use in the goal apparatus, comprising: a first edge, a second edge and a third edge connected between said first and second edges, a first pliable goalpost element extending along said first edge, a second pliable goalpost element extending along said second edge and a pliable crossbar element extending along said third edge, and said first pliable goalpost element, said second pliable goalpost element and said third crossbar element collectively present a first lower frame connection element, a first upper frame connection element, a second lower frame connection element and a second upper frame connection element.

According to a fourth aspect of the present invention, there is provided a method of providing a goal, comprising the steps of: providing a frame having a first lower net connection element and a first upper net connection element, and a second lower net connection element and a second upper net connection element; providing a first pliable goalpost member, a second pliable goalpost member and a third pliable crossbar member, connecting said first pliable goalpost member between said first lower net connection point and said first upper net connection point, connecting said second pliable goalpost member between said second lower net connection point and said second upper net connection point, and connecting said pliable crossbar member on between said first upper net connection point and said second upper net connection point.

All of the features contained herein may be combined with any of the above aspects and in any combination.

For a better understanding of the invention, and to show how embodiments of the same may be carried into effect, reference will now be made, by way of example, to the accompanying diagrammatic drawings in which:

WRITTEN DESCRIPTION OF THE BEST MODE FOR CARRYING OUT THE INVENTION

FIG. 1

Figure 1:
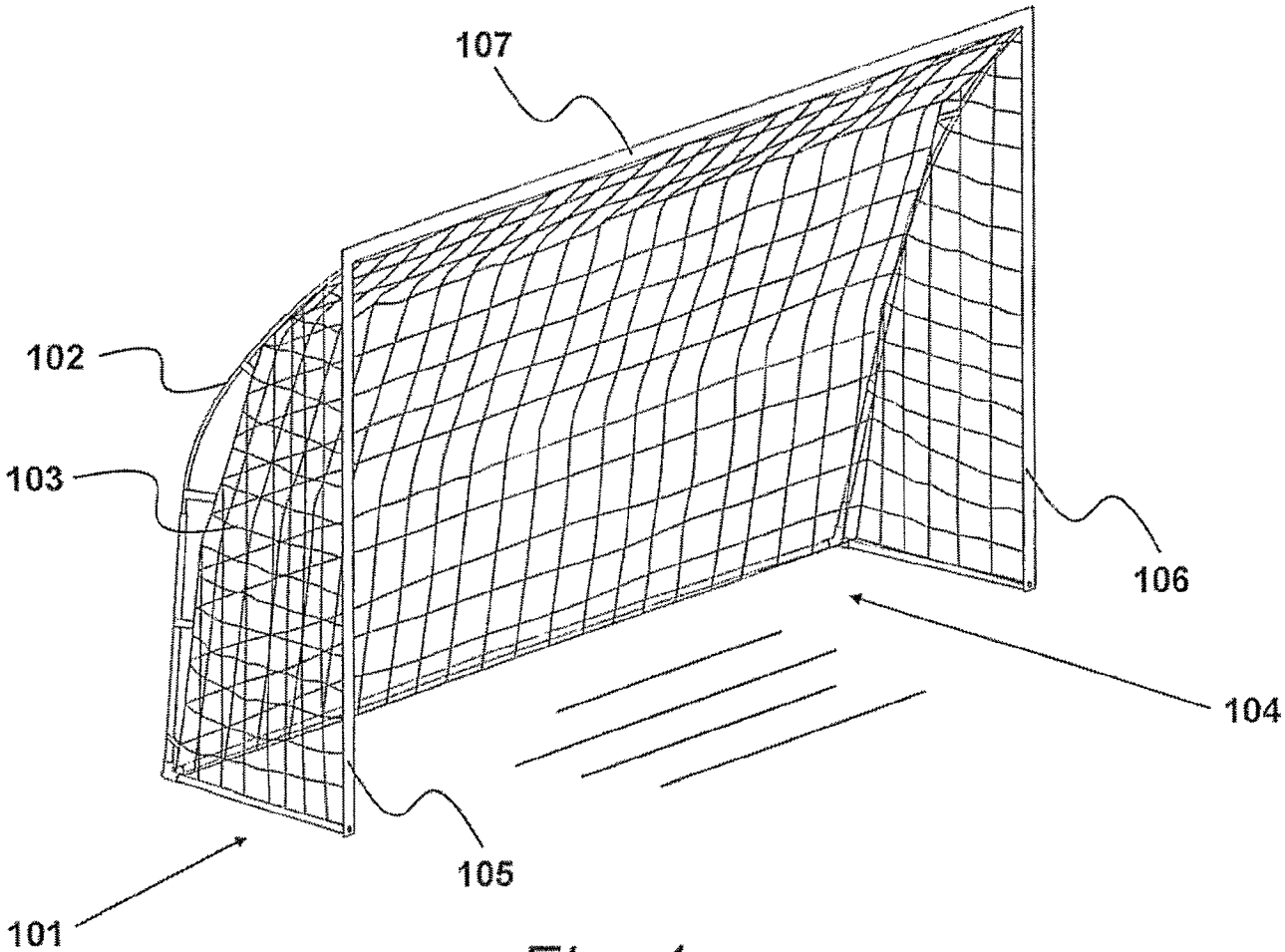
FIG. 1 shows a goal apparatus, assembled for use.

FIG. 1 shows a goal apparatus 101. According to the illustrated embodiment, the goal apparatus is configured for use as a football goal. The goal apparatus 101 is configured to be portable and is intended to imitate a similar type of goal that is permanently installed. Thus, the goal apparatus 101 functions to provide a goal that realistically reflects the aesthetics and functionality of a permanent goal of an equivalent type.

The goal apparatus 101 comprises a frame 102 and a net 103 that is releasably connectable to the frame 102. When erected as shown, the net 103 presents a goal mouth 104. A first goal mouth perimeter edge 105 extends substantially parallel to a second goal mouth perimeter edge 106 and a third goal mouth perimeter edge 107 extends substantially perpendicularly to the first and second goal mouth perimeter edges 105, 106. When the goal apparatus 101 is rested on substantially level ground, as shown, the third goal mouth perimeter edge 106 extends substantially parallel to the lie of the ground. Thus, the goal mouth 104 is substantially rectangular. In addition, the goal mouth 104 is oriented substantially perpendicular to the ground. Thus, when the goal apparatus 101 is resting on substantially horizontal ground, the goal mouth 104 is substantially vertical.

When the frame 102 and the net 103 are connected as shown, the frame 102 is in compression and is arranged to support the first, second and third goal mouth perimeter edges 105, 106, 107 in tension.

FIG. 2

Figure 2:
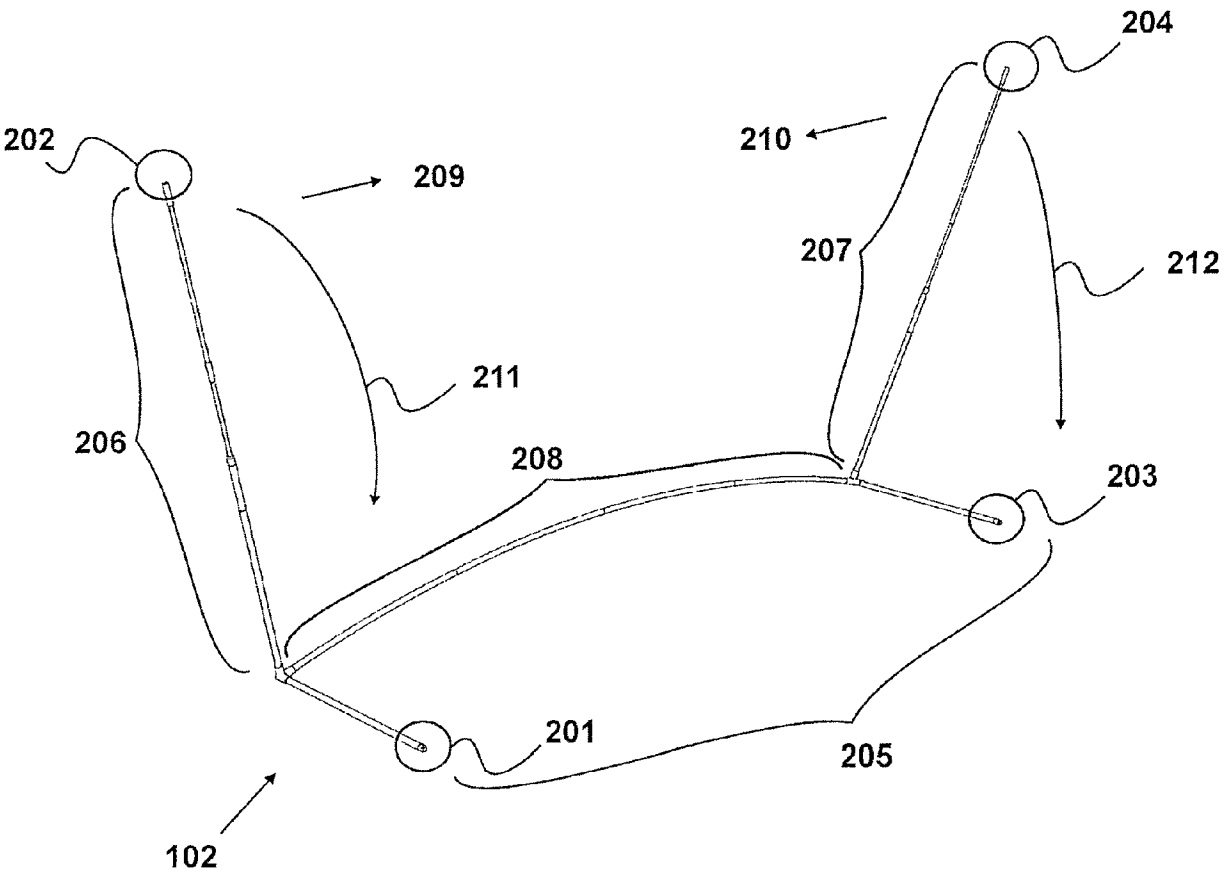
FIG. 2 shows the frame of the goal apparatus of FIG. 1.

Frame 102 of goal apparatus 101 is shown in further detail in FIG. 2.

Frame 102 presents a first lower net connection point 201, a first upper net connection point 202, a second lower net connection point 203 and a second upper connection point 204. When the frame 102 is erected as shown, the first lower and upper net connection points 201, 202 are spaced apart vertically. Similarly, the second lower and upper net connection points 203, 204 are spaced apart vertically. The first lower and upper net connection points 201, 202 are spaced apart laterally from the second lower and upper net connection points 203, 204.

As described in further detail below, frame 102 is configured to support a first pliable goalpost member in tension, a second pliable goalpost member in tension and a third pliable crossbar member in tension. The first pliable goalpost member is configured to be supported in tension between the first lower and upper net connection points 201, 202. Similarly, the second pliable goalpost member is configured to be supported in tension between the second lower and upper connection points 203, 204. The third pliable crossbar member is configured to be supported in tension between the first and second upper net connection points 202, 204.

According to the illustrated embodiment, the frame 102 comprises a base member 205 for resting on a support surface, a first post member 206 and a second post member 207 spaced apart laterally from the first post member 206. The first and second post members 206, 207 are connected to the base member 205. The base member 205 comprises an elongate rear base member 208, and when the frame 102 is at rest, the rear base member 208 presents a curvature.

The base member 205 presents the first and second lower net connection points 201, 203, whist the first and second post members 206, 207 present the first and second upper net connection points 202, 204 respectively. The first and second upper net connection points 202, 204 of the frame 102 are normally biased apart laterally from a position relative to each other at which the elongate rear base member 208 is placed in compression. In addition, the first and second upper net connection points 202, 204 of the frame 102 are normally biased apart vertically from a position relative to the base member 205 at which the first and second post members 206, 207 are placed in compression. Thus, the first and second upper connection points 202, 203 are normally biased apart from a position at which the frame 102 is placed in compression.

According to the illustrated frame, the frame 102 is arranged to be placed in compression by manual reconfiguration of the first and second post members 206, 207 relative to the base member 205. The first and second post members 206, 207 are each arranged for the upper net connection point thereof to be brought inwardly towards the other, as indicated by arrows 209 and 210, such that the curvature of the elongate rear base member 208 is removed. In a specific embodiment, the frame 102 is arranged such that the curvature of the elongate rear member 208 is removed when the first and second side post members 206, 207 are angled substantially perpendicularly to the elongate rear member 201. The first and second post members 206, 207 are each arranged for the upper net connection point thereof to be brought downwardly towards the base member 205, as indicated by arrows 211 and 212, such that each presents a curvature.

The frame 102 is arranged to be brought into compression during connection of a first pliable goalpost member, a second pliable goalpost member and third pliable crossbar member, and thereafter to hold the pliable goal opening in tension.

FIG. 3

Figure 3:
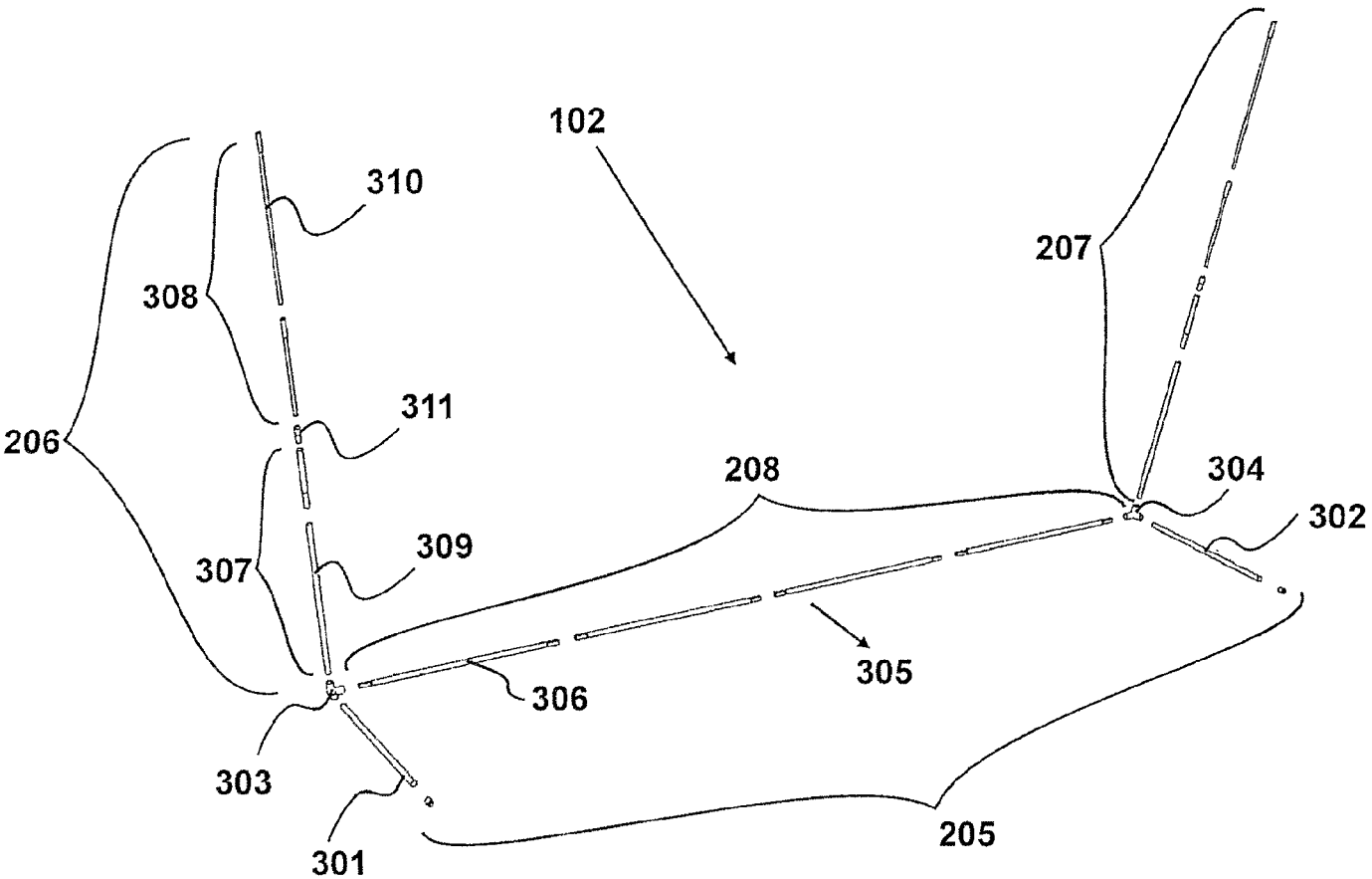
FIG. 3 shows the frame of FIGS. 1 and 2 in further detail.

Frame 102 is shown in further detail in FIG. 3. In addition to the elongate rear base member 208, the base member 205 comprises a first side base member 201, a second base member 302, a first corner member 303, and a second corner member 304. The first and second corner members 303, 304 are each arranged to receive an end of the elongate rear base member 208 and an end of a side base member 301, 302 such that the first and second side base members 301, 302 extend in a forward direction, indicated by arrow 305, from the elongate rear base member 208. The first and second corner members 303, 304 are each also arranged to receive an end of a side post member 206, 207.

Elongate rear base member 208 comprises a plurality of polar members, such as polar member 306, which are arranged to be releasable connectable. Herein, the term 'polar' is used to express the pole-like or tube-like nature of the members. In the shown example, the elongate rear base member 208 comprises four (4) polar members. However, in alternative embodiments, the elongate rear base member 208 may comprise a greater or lesser number of component members. In a specific embodiment, the elongate rear base member is fabricated at least partially from steel.

Each of the first and second side base members 301, 302 comprise a unitary polar member. However, in alternative embodiments, each of the first and second side base members 301, 302 may comprise a plurality of component members. In a specific embodiment, the first and second side base members are fabricated at least partially from steel.

The first and second post members 206, 207 each comprise a lower polar member, such as lower polar member 307 of first post member 206, and an upper polar member, such as upper polar member 308 of first post member 206. The lower polar members comprise a plurality of polar members, such as polar member 309 of lower polar member 307, which are arranged to be releasably connectable. Lower polar member 307 comprises two (2) polar members. However, in alternative embodiments, the lower polar members may comprise a unitary polar member or may comprise a greater number of component members. In a specific embodiment, the lower polar members are fabricated at least partially from steel. Similarly the upper polar members comprise a plurality of polar members, such as polar members 310 of upper polar member 308, which are arranged to be releasably connectable. In the shown example, the upper polar member 308 comprises two (2) polar members. However, in alternative embodiments, the lower polar members may comprise a unitary polar member or may comprise a greater number of component members. In a specific embodiment, the lower polar members are fabricated at least partially from fibreglass. In the shown example, the upper polar member of a side post member is arranged to be releasably connected to the lower polar member of a side post member by means on an intermediate connector member, such as intermediate connector member 311 of first post member 206.

In one embodiment, the first and second post members 206, 207 are formed from a telescopic pole having a lower member made of steel and an upper member made of fibreglass. In general, the post members 206, 207 may be formed from a lower rigid portion, which may comprise a plurality of rigid members and an upper resilient member, which may comprise a number of resilient members. However, it is not beyond the scope of the present invention the form the first and second post members 206, 207 from resilient materials.

In a specific embodiment, the intermediate connector member is fabricated at least partially from nylon or ABS (acrylonitrile-butadiene-styrene). In alternative embodiments, the upper polar member of a side post member may be arranged to be directly releasably connectable to the lower polar member of the side post member.

Component polar members of a part of the frame 102 may be linked together in a linear arrangement that allows that part to be collapsed down such that the polar members thereof are in a folded arrangement. The polar members may therefore be linked together by a cord, for example a shock cord, in a similar manner to that used in the field of tent poles. Thus, for example, the polar members of the rear elongate base member 208 may be connected in this way. The polar members may any selected desired cross-sectional shape, for example a substantially circular or rectangular shape.

In a specific embodiment, the corner members are fabricated at least partially from nylon or ABS (acrylonitrile-butadiene-styrene).

Colouration and/or graphical indicia may be used upon the frame 102, to facilitate assembly, for example by providing an indication of a particular type of component, orientation of a particular component or the position of a component in a sequence of assembly.

To assemble the frame 102, the elongate rear base member 208, the first and second corner members 303, 304 and the first and second side base members 301, 302 are connected as described to form the base frame 205. The first and second post members 206, 207 are then connected to the first and second corner members 303, 304 to complete the frame 102.

Once assembled, the frame is configured to be placed in compression to support first, second and third pliable goal members in tension.

FIG. 4

Figure 4:
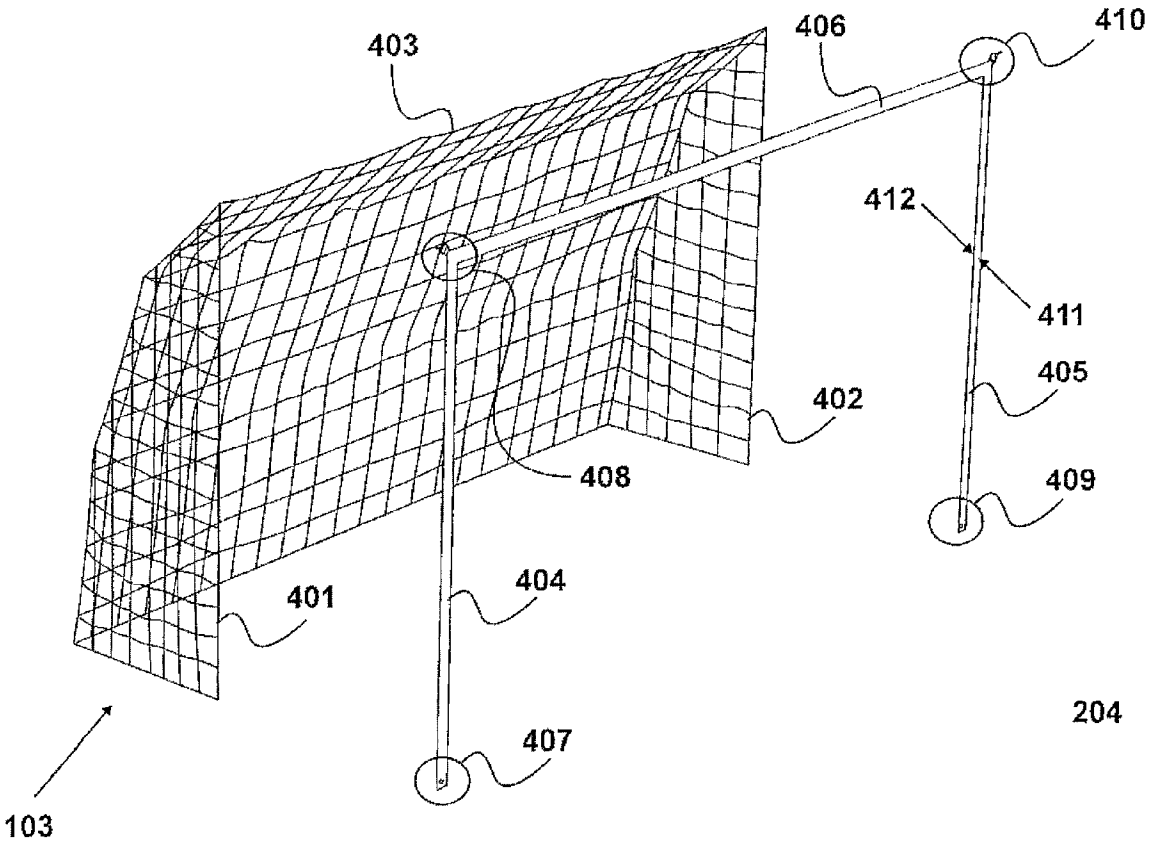
FIG. 4 shows the net of the goal apparatus of FIG. 1.

An exploded view of net 103 of the goal apparatus of FIG. 1 is shown in FIG. 4. As previously described, the goal apparatus is configured to provide a goal mouth having a first perimeter edge that extends substantially parallel to a second perimeter edge, and a third perimeter edge that extends substantially perpendicularly to the first and second perimeter edges. The first perimeter edge is provided by a first pliable goalpost member, the second perimeter edge is provided by a second pliable goalpost member, and the third perimeter edge is provided by a pliable crossbar member. Herein, the term 'pliable' is used to express the flexible, supple, collapsible nature of the members.

Net 103 comprises a first goalpost edge 401, a second goalpost edge 402 and a third crossbar edged 403 connected between the first and second goalpost edges 401, 402. Preferably, and in the shown example, net 103 further comprises a first pliable goalpost element 404, a second pliable goalpost element 405 and a pliable crossbar element 406. The first pliable goalpost element 404 extends along the second goalpost edge 402 and the pliable crossbar element 406 extends along the third crossbar edge 403. The first and second pliable goalpost elements 404, 405 and the pliable crossbar element 406 provide the first and second pliable goalpost members and the pliable crossbar member of the goal apparatus respectively.

The first and second pliable goalpost elements 404, 405 and the pliable crossbar element 406 are attached to the first, second and third edges 401, 402, 403 of the net respectively. In addition, the crossbar element 406 is attached to the first and second flexible goalpost elements 401, 402.

In a specific embodiment, the net is fabricated substantially from polyethylene and each of the flexible goalpost elements 404, 405 and the flexible crossbar element 406 are fabricated substantially from PVC (polyvinyl chloride), which may have a woven structure.

Net 103 is releasably connected to frame 102. To facilitate connection, net 103 comprises a first lower frame connection point 407, a first upper frame connection point 408, a second lower connection point 409 and a second upper frame connection point 410. In the illustrated embodiment, the first and second pliable goalpost elements 404, 405 and the pliable crossbar element 406 collectively present the frame connection points 407, 408, 409, 410. In particular, the first lower frame connection point 407 is located towards the free end of the first goalpost element 404 and the second lower frame connection point 409 is located towards the free end of the second goalpost element 405. The first upper frame connection point 408 is located at the corner of the first goalpost element 404 and the crossbar element 406 and the second upper frame connection point 410 is located at the corner of the second goalpost element 405 and the crossbar element 406. Thus, when the net 103 is spread out as shown, the first lower and upper frame connection points 407, 408 are spaced apart vertically. Similarly, the second lower and upper frame connection points 409, 410 are spaced apart vertically. The first lower and upper frame connection points 407, 408 are spaced apart laterally from the second lower and upper frame connection points 409, 410.

The first lower and upper frame connection points 407, 408 of the net 103 are configured to engage with the first lower and upper net connection points of the frame respectively. Similarly, the second lower and upper frame connection points 409, 410 of the net 103 configured to engaged with the second lower and upper net connection points of the frame respectively.

In the shown example, the goalpost elements 404, 405 and the flexible crossbar 406 each have a front face, indicated by arrow 411, and a rear face, indicated by arrow 412. In a specific embodiment, at least one of the pliable goalpost members and the pliable crossbar member includes a colouration or a graphical indicia, such as a word or symbol, to indicate at least one of the front face and the rear face thereof. This feature serves to facilitate user identification of the correct orientation of the net in preparation for attaching the net to the frame.

In an alternative embodiment, the first and second goalpost edges 401, 402 and the crossbar edge 403 of the net 103 itself provide the first and second pliable goalpost members and the pliable crossbar member of the goal apparatus respectively. In a further alternative embodiment, the first and second goalpost elements 404, 405 and the crossbar element 406 are provided separately, either as discrete elements or as a connected arrangements, and provide the first and second pliable goalpost members and the pliable crossbar member of the goal apparatus respectively.

FIG. 5

Figure 5:
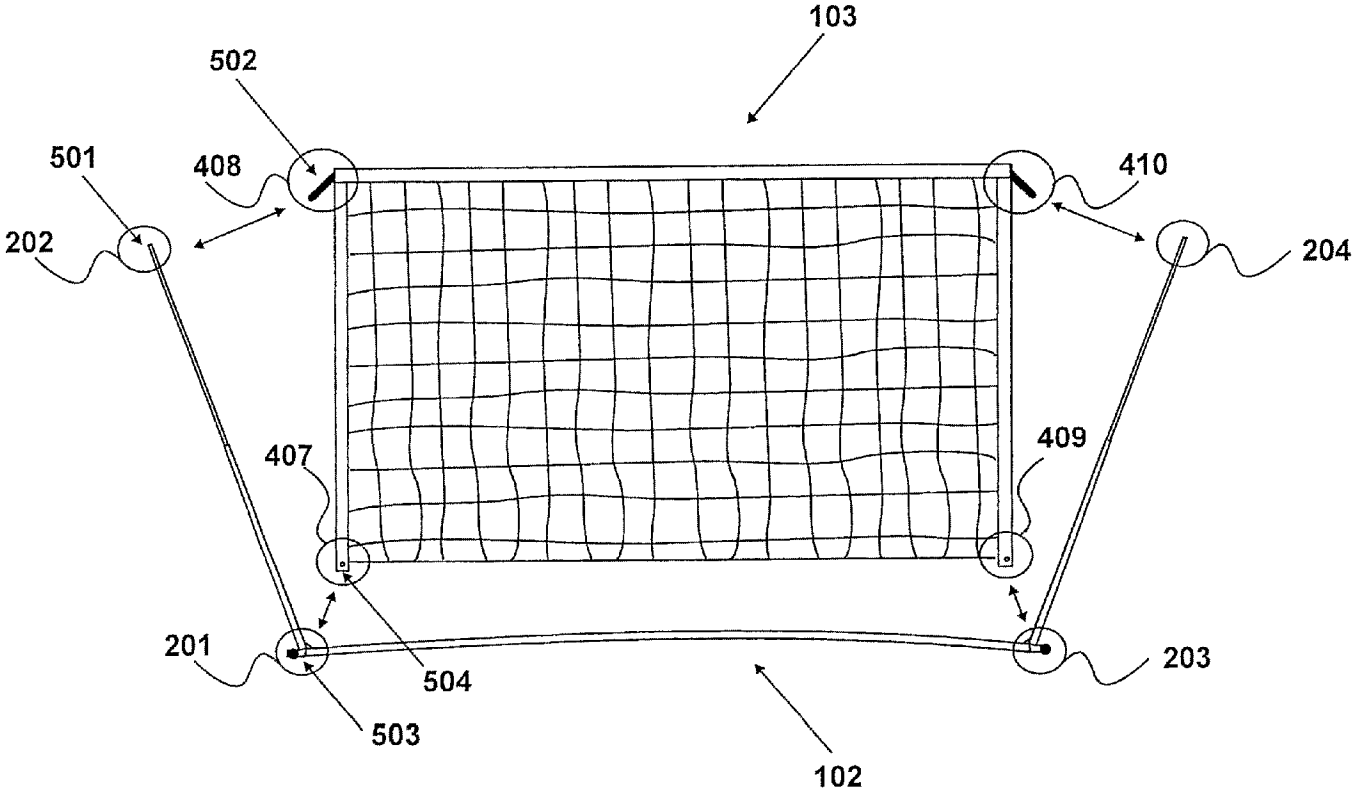
FIG. 5 shows the frame and net of the goal apparatus of FIG. 1.

FIG. 5 illustrates assembled frame 102 and net 103.

The frame connection points 201 to 204 of the net 103 are connected to the corresponding net connection points 407 to 410 of the frame 102. The upper net connection points 202, 204 of the frame 102 are configured into a relative position at which the distance between the upper net connection points is equal to or less than the distance between the upper frame connection points 408, 410 of the net 103. In addition, the first lower and upper net connection points 201, 202 of the frame 102 are configured into a relative position at which the distance between the first lower and upper net connection points is equal to or less than the distance between the first lower and upper connection points 407, 408 of the net 103. Similarly, the second lower and upper net connection points 203, 204 of the frame 102 are configured into a relative position at which the distance between the second lower and upper net connection points is equal to or less than the distance between the second lower and upper frame connection points 409, 410 of the net 103.

In the specific embodiment, the relative positions between net connection points can be achieved by manipulating each side member 206, 207 to move the respective upper net connection point inwardly and sideways towards the other upper net connection point and also forwardly and downwards towards the respective lower net connection point. In a specific embodiment, the first and second side base members 301, 302 are also arranged to be moved from the at rest position when the net is connected to the frame.

The upper frame connection points 408, 410 of the net 103 may be connected to the upper net connection points 202, 204 of the frame 102 before the lower frame connection points 407, 409 are connected to the lower net connection points 201, 203. Alternatively, the upper and lower frame connection points of one side of the net 103 may be connected to the upper and lower net connection points of the other side of the net 103 are connected to the net connection points of the other side of the frame 102.

In a specific embodiment, each of the first and second upper net connection points 202, 204 comprises an open end 501 of each of the first and second post members 206, 207 respectively. Each of the first and second upper frame connection points 408, 410 comprises a pin 502 configured to be received within the open end 501 of each of the first and second side post members 206, 207 respectively of the frame 102.

In a specific embodiment, each of said first and second lower net connection points 201, 203 of the frame 102 comprises a projection 503. Each of said first and second lower frame connection points 407, 409 of the net 103 defines an aperture 504, for example provided by an eyelet member, configured to be hooked over the projection 503 of the first and second lower net connection points 201, 203.

When the net 103 is connection to the frame 102 as described, the net 103 is held in tension by the frame 102.

FIG. 6

Figure 6:
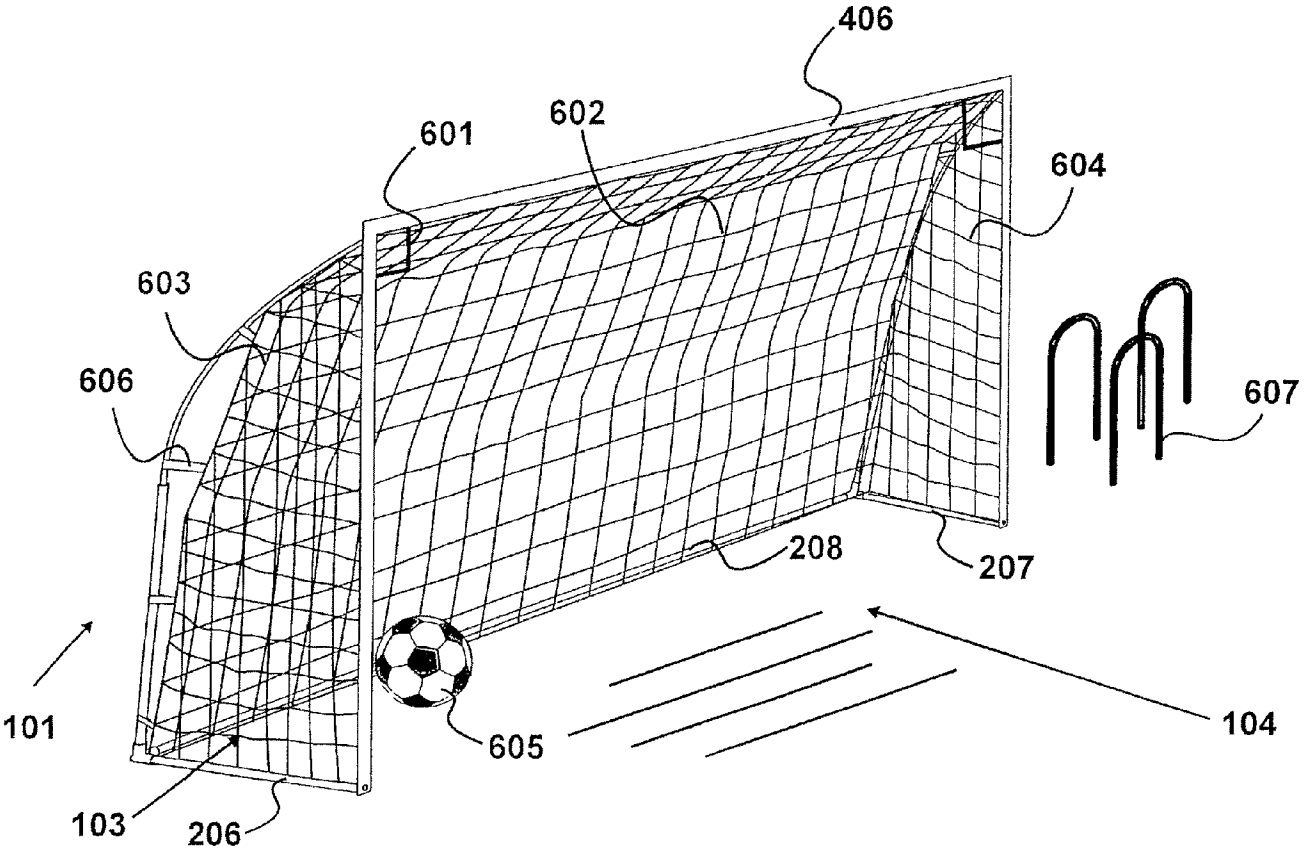
FIG. 6 shows the goal apparatus of FIG. 1.

The goal apparatus 101 of FIG. 1 is also shown in FIG. 6.

When the goal apparatus 101 is assembled as described, the net 103 presents a goal mouth 104 having substantially square corners 601.

It can be seen that the net 103 provides a rear wall 602 disposed between a first side wall 603 and a second side wall 604. Thus, the net 103 presents an enclosure from which a ball, such as football 605, is easily retrievable once it has through the goal mouth 04.

Net 103 comprises a plurality of additional attachment devices 606 configured to extend around the frame 102, in particular one of the first and second post members 206, 207 and the elongated rear base member 208. In a specific embodiment, the plurality of additional attachment devices comprises a plurality of hook and loop devices.

In a specific embodiment, the plurality of attachment devices allow a degree of movement of the net 103 relative to the frame 102 when the plurality of additional attachment devices are in use.

Preferably, an additional degree of tension is imparted into the pliable crossbar element 406 of the net 103 when the additional attachment devices are in use.

The portable goal apparatus 101 may further include securing means to secure the assembly to a supporting surface. The goal assembly may be secured to the ground by means of hooks, stakes or hoops, for example hoop 607. Alternatively, on more solid ground or where inserting securing means into the ground is not favourable, the portable goal apparatus 101 may be held down by the use of weights, such as sandbags, for example.

FIG. 7

Figure 7:
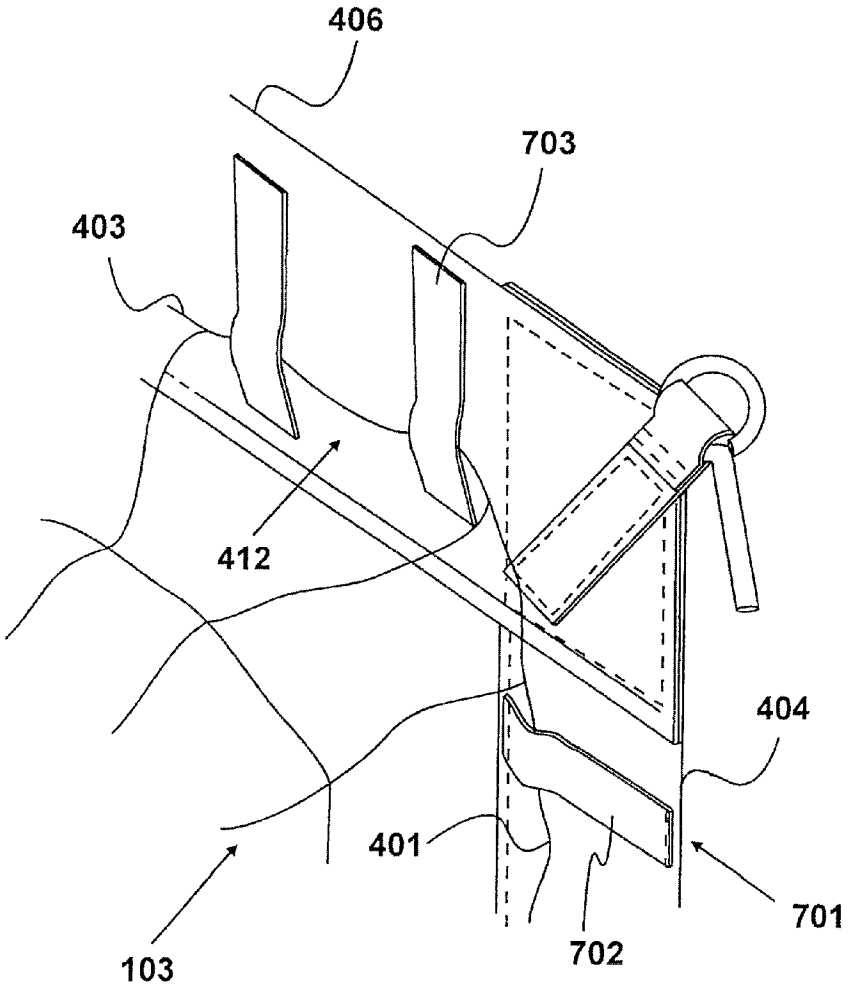
FIG. 7 shows a corner of the net of the goal apparatus of FIG. 1.

FIG. 7 shows net 103, at the corner of pliable goalpost member 404 and pliable crossbar member 406.

In a specific embodiment, the rear face 412 of each of the pliable goalpost elements 404, 405 (not shown) and the pliable crossbar element 406 is attached to an edge 401, 402 (not shown) 403 of the net 103 respectively at discrete attachment locations, such as location 701. In the illustrated embodiment, the attachment locations comprise tabs, such as tab 702, and the net edges are secured to the pliable goalpost elements and pliable crossbar element through the tabs, whereby a degree of movement of the net edges relative to the pliable goal elements is allowed.

Preferably, the outermost attachment locations along at least the pliable crossbar element 406 such as locations 703, secure the corresponding net edge(s) at points more radially outwardly displaced from the centre of the net 103 when spread out, than the intermediate attachment locations.

FIG. 8

Figure 8:
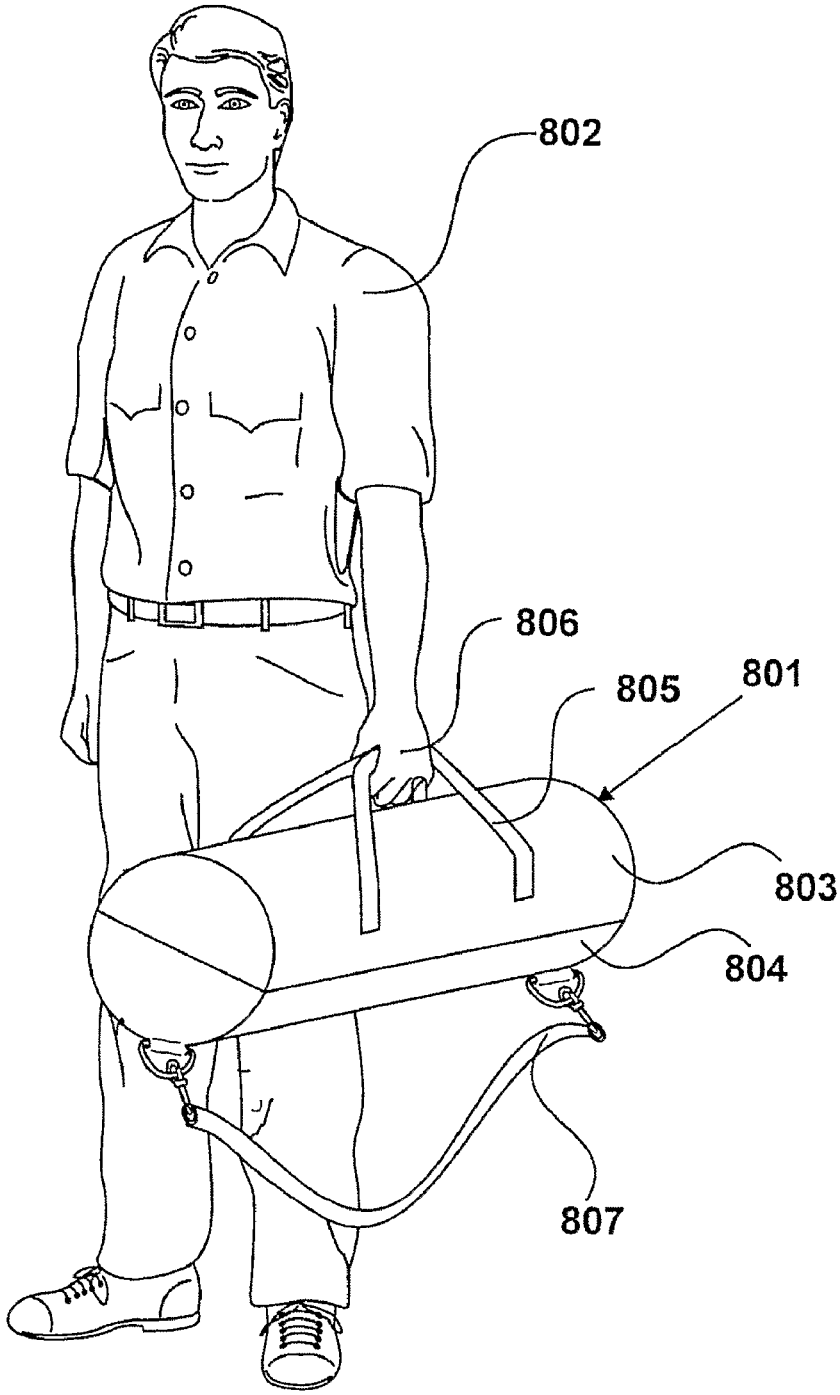
FIG. 8 shows a bag to facilitate manual transportation of the goal apparatus of FIG. 1.

As shown in FIG. 8, the goal apparatus of the present application preferably comprises a bag 801 to facilitate manual transportation of the portable goal apparatus by a user 802. The bag 801 may comprise a first compartment 803 for receiving a frame and a second compartment 804 for receiving a net or pliable goal elements to prevent tangling of the frame with the net or pliable goal elements. The bag 801 may include at least one carry handle 805 that is configured to be gripped in a hand 806 of a user, and may include a releasable shoulder strap 807.

The bag may have a square, rectangular or circular section. In a specific embodiment, a bag is provided having a length dimension of approximately 80 cm and a maximum width dimension of approximately 20 cm. The bag may be fabricated at least partially from nylon, and may be waterproof. Preferably the bag has a closure arrangement. A closure may for example comprise one of a zip closure, a drawstring closure or hook and loop closure.

The portable goal apparatus of the present application is preferably configured to be assembled by a single person, but may be configured to be assembled by a single adult but a plurality of adolescents.

FIG. 9

Figure 9:
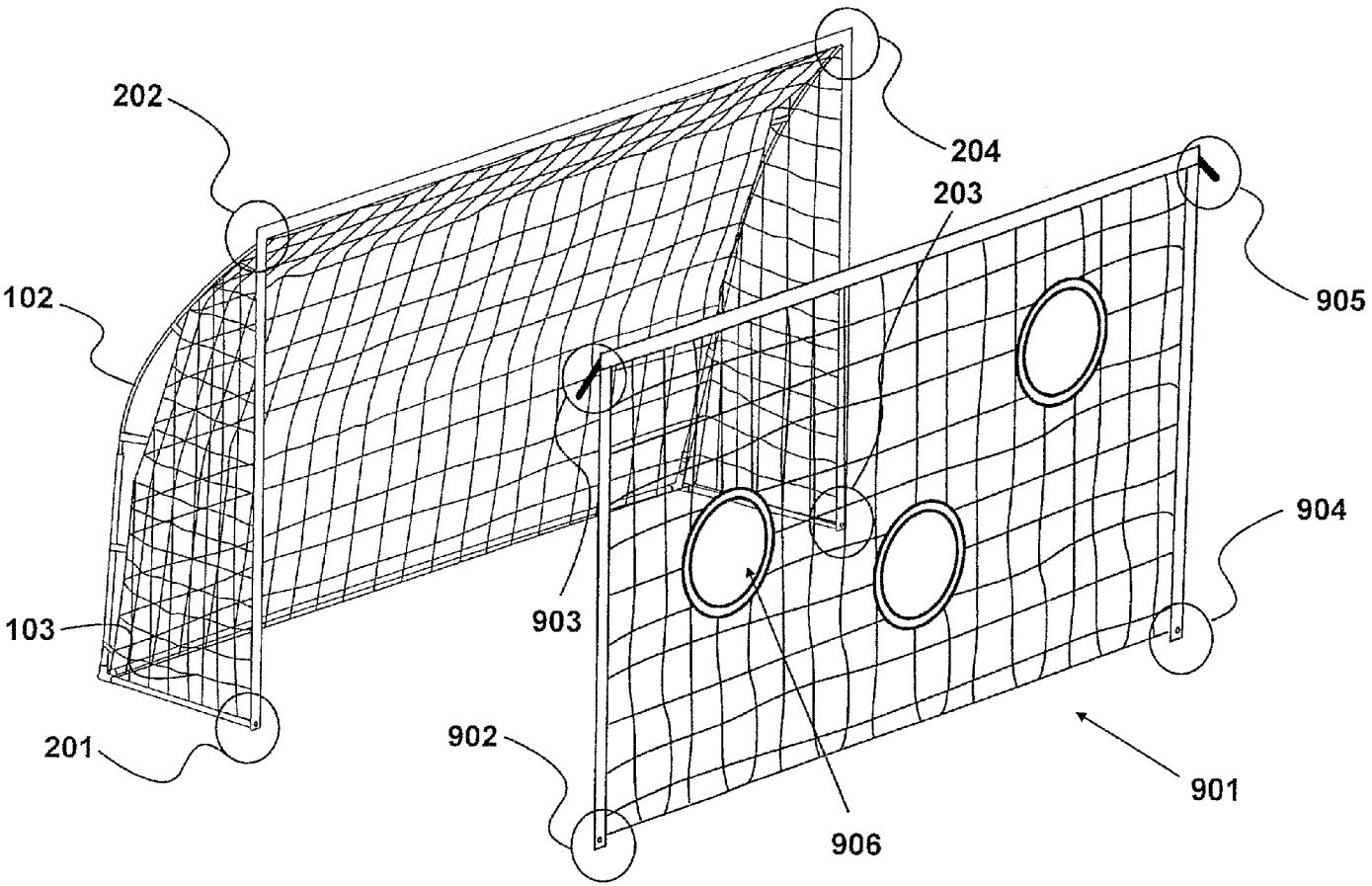
FIG. 9 shows an additional net.

FIG. 9 illustrates an additional net 901. Net 901 is releasably connectable to frame 102. The additional net 901 has frame connection points 902 to 905 allowing it to be connected to net connection points 201 and 204. Net 901 defines at least one aperture 906 for allowing a ball to pass therethrough. Hence, the additional net 901 may be used for target practice.

The goal apparatus 101 is arranged to allow net 901 to be attached to the frame 102 forward of net 103. Alternatively, net 901 may be attached to the frame 102 absent net 103.

In a specific embodiment, net 901 includes similar pliable goal members and frame connection means as described with reference to net 103. The net 901 is also configured to be held in tension by the frame 102 in a similar manner as that described with reference to net 103.

FIG. 10

Figure 10:
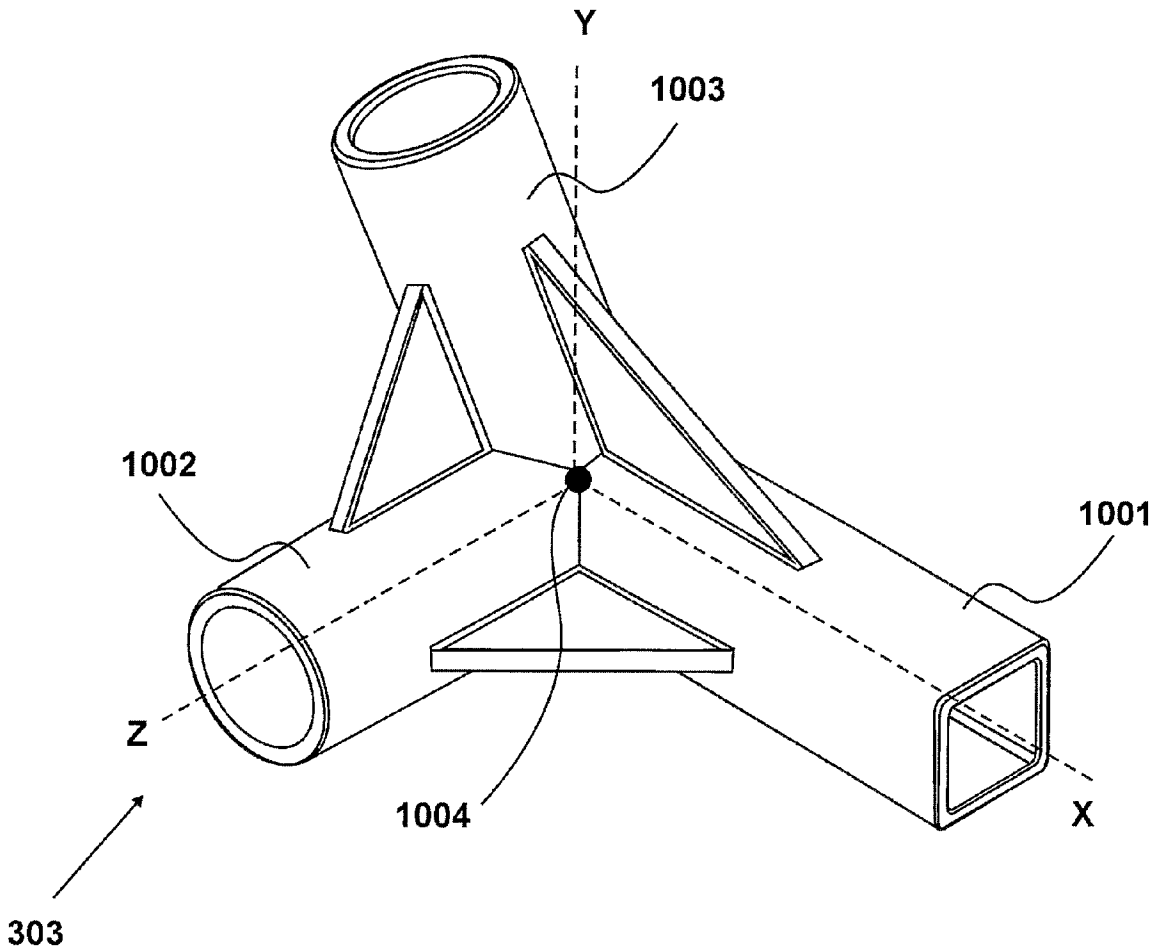
FIG. 10 shows a corner member of the frame of FIG. 2 in further detail.

A corner member of frame 102 is shown in further detail in FIG. 10. Corner member 303 comprises a first projection 1001, a second projection 1002 and a third projection 1003.

FIG. 10 also shows X, Y and Z axes having an origin 1004 towards the central region of the corner member from which the first, second and third projections 1001, 1002, 1003 extend. The relative angles between the first, second and third projections 1001, 1002, 1003 can be selected such that when used as part of frame 102, the corner member 303 assists in placing the frame of the goal apparatus in compression. According to the illustrated embodiment, the first projection 1001 makes an interior angle of ninety-four (94) degrees with the second projection 1002. The second projection 1002 makes an interior angle of eighty-two (82) degrees with the third projection 1003. The third projection 1003 makes an interior angle of one hundred and six (106) degrees with the first projection 1001. These relative angles are mirrored for the other corner member 304.

Alternatively, corner members may be provided having projections with different angles to those stated above. For example, the angles may be as follows: the first projection 1001 may make an interior angle of between about 90 and 100 degrees with the second projection 1002. The second projection 1002 may make an interior angle of between about 75 to 85 degrees with the third projection 1003. The third projection 1003 may make an interior angle of between about 100 and 110 degrees with the first projection 1001. An example of an alternative corner member having different angles to those described in relation to FIG. 10 is described in relation to FIGS. 13*a* to 13*d*, hereunder.

It will be appreciated by one skilled in the art that the angles may be varied to suit the flexibility of the materials of the frame members. For example, if the frame member is formed from a particularly flexible material, then a greater angle may be provided such that the side frame members face further outward (relative to each other) at the base thereof.

The degree of compression into which the frame is placed when connected to the pliable goal members of the goal apparatus may be varied by varying the relative angles between the first, second and third projections of the corner members.

Figure 11A:
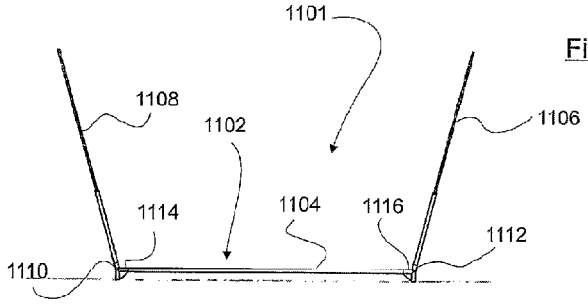
FIGS. 11*a* and 11*b* show a further embodiment of the goal apparatus, partially assembled.
Figure 11B:
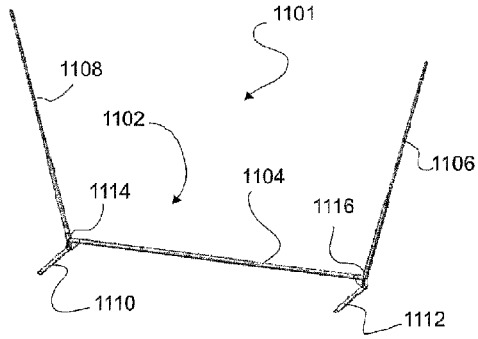

FIGS. 11*a* and 11*b*

Referring now to FIGS. 11*a* and 11*b* there is provided a further embodiment of a goal apparatus 1101 in a partially assembled configuration. The apparatus 1101 comprises a frame 1102 having five elongate frame members 1104, 1106, 1108, 1110, 1112 being a rear frame member 1104, two generally upwardly extending side frame members 1106, 1108 and two forwardly extending side frame members 1110, 1112. The frame members 1104, 1106, 1108, 1110, 1112 are connected together to form the frame apparatus 1101 via corner members 1114, 1116.

As shown in FIGS. 11*a* and 11*b*, the frame apparatus is only partially assembled in that there is no net attached thereto. In this configuration it is clear to see that the rear frame member 1104 stands above the lower extent of the corner members 1114, 1116 and thus the rear frame member 1104 does not touch the ground in this partially assembled configuration.

Figure 12A:
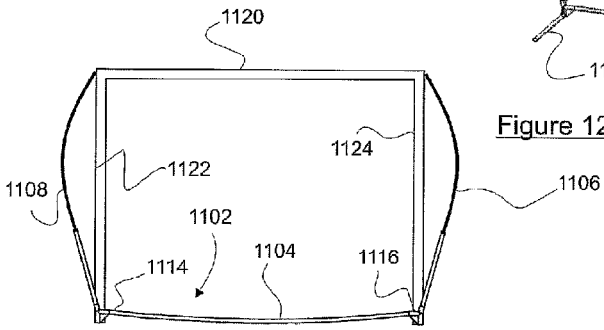
FIGS. 12*a* and 12*b* show the embodiment of the goal apparatus of FIGS. 11*a* and 11*b* in an assembled configuration.
Figure 12B:
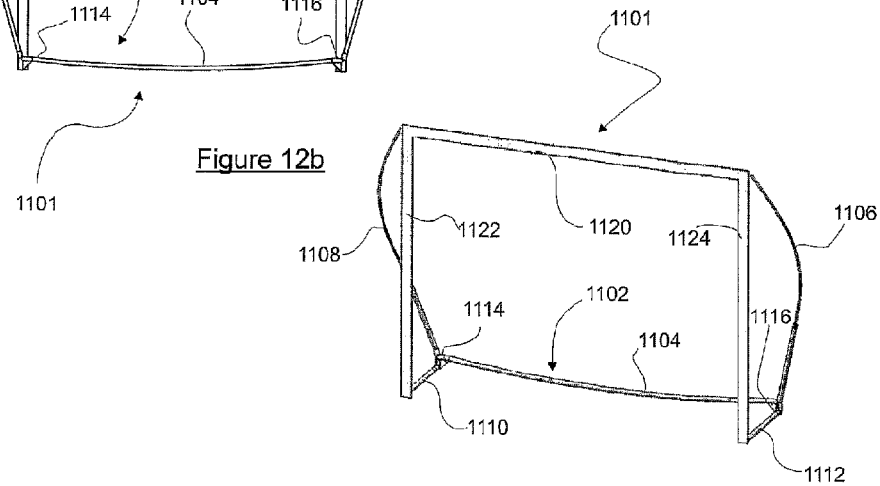

FIGS. 12*a* and 12*b*

Referring now to FIGS. 12*a* and 12*b* there is shown the embodiment of the goal apparatus 1101 as shown in FIGS. 11*a* and 11*b*, but in an assembled configuration. The apparatus 1101 comprises a crossbar 1120 and posts members 1122, 1124, all being formed from a pliable material, in this instance, a cloth material. For ease of understanding of the figures, the net is not shown in FIGS. 12*a* and 12*b*, however a net would normally be present. As can be seen in FIGS. 12*a* and 12*b*, in this embodiment, the rear frame member 1104 bows downward when the frame is assembled to assist in absorbing the compression of the side frame members 1106, 1108.

The side frame members 1106, 1108 are formed from a two part construction having a lower, rigid part 1106*a*, 1108*a* and an upper resilient part 1106*b*, 1108*b*. This construction ensures that the lower part of the frame members extend sufficiently outwardly, before the resilient parts 1106*b*, 1108*b* bend inward under tension to attach to the crossbar and posts.

FIGS. 13*a* to 13*d*

FIGS. 13*a* to 13*d* show different projections of an alternative corner member 1210. For ease of reference, the projections of the corner member 1210 have been assigned numerals that correspond with like parts of the corner member 1001, but prefixed with "12" instead of "10".

Figures 13A, 13B, 13C, 13D:
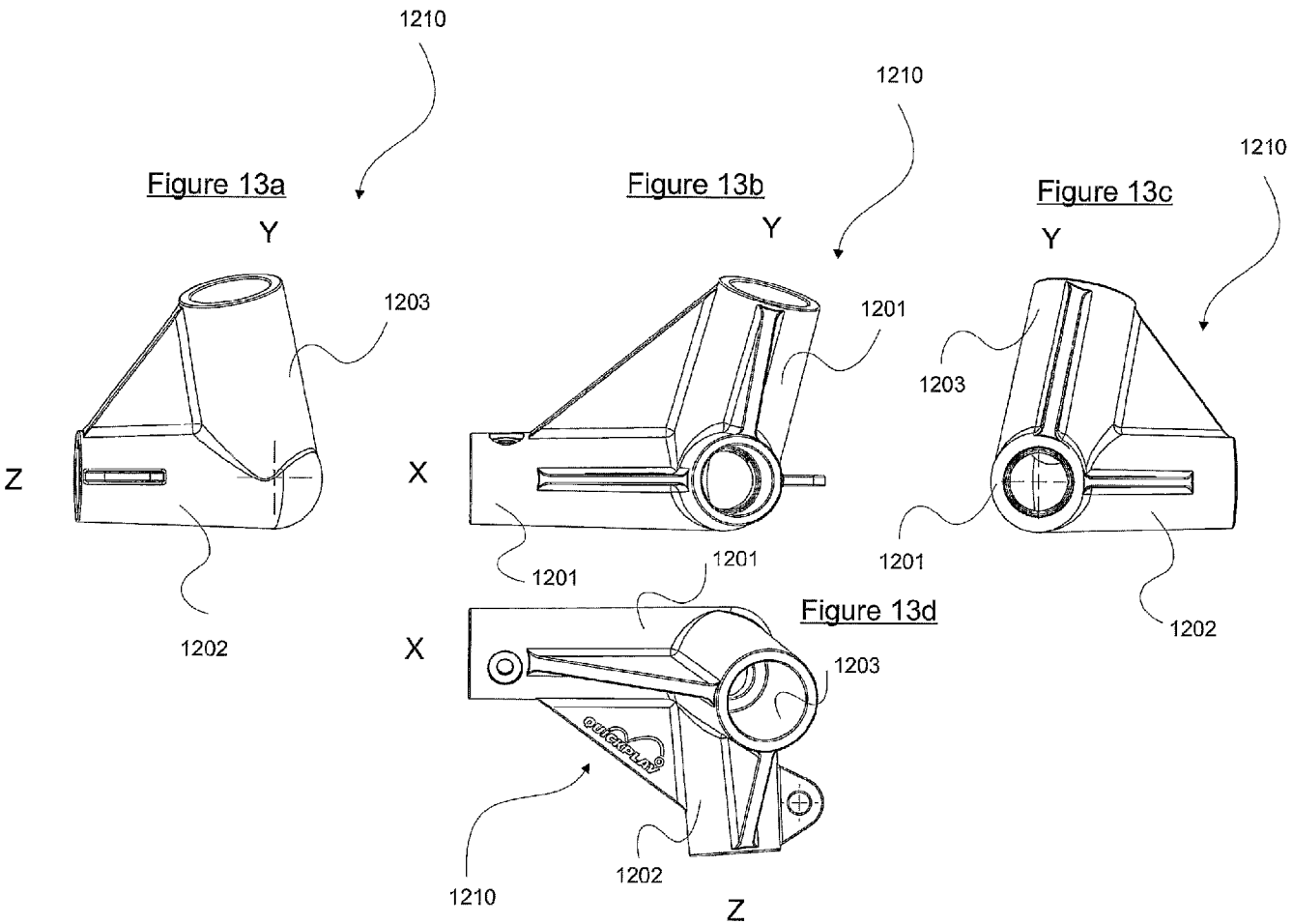
FIGS. 13*a* to 13*d* show an alternative embodiment of a corner member.

FIGS. 13*a* and 13*c* shows opposite side elevations along the Y and Z axes, FIG. 13*b* shows a front elevation along the X and Y axes, while FIG. 13*d* shows a plan elevation along the X and Z axes.

As can be seen by the various projections in FIGS. 13*a* to 13*d*, the projection 1201 makes an internal angle of 94 degrees with the projection 1202. The second projection 1202 makes an internal angle of 77 degrees with the projection 120. The first projection 1201 makes an internal angle of 105 with the projection 1203.

A goal apparatus formed in accordance with the present invention has the advantage that it is formed from very few non-pliable parts, thus allowing it to be stored easily and into a small, light configuration. The provision of first and second upper net connection points of the frame are biased apart laterally from a position relative to each other results in an apparatus that does not require any solid crossbar or post members and the frame is not situated inside the net, thus not impeding the goal enclosure.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A sports net apparatus, comprising:

a frame including:

left and right flexible posts; left and right side members; and a base member;

the left flexible post having an upper end and a lower end, with the lower end of the left flexible post attached to a left corner fitting at a left end of the base member;

the right flexible post having an upper end and a lower end, with the lower end of the right flexible post attached to a right corner fitting at a right end of the base member;

the left side member having a front end and a back end, with the back end of the left flexible side member attached to the left corner fitting;

the right side member having a front end and a back end, with the back end of the right side member attached to the right corner fitting;

the left and right corner fittings each having receptacles extending on a lateral axis, a longitudinal axis and on a vertical axis, and with the lateral axis intersecting and substantially perpendicular to the longitudinal axis, and with the vertical axis intersecting and at an obtuse angle to the lateral axis; and a net including:

a lower left corner attached adjacent to the front end of the left side member;

a lower right corner attached adjacent to the front end of the right side member;

an upper left corner attached to an upper end of the left flexible post;

a upper right corner attached to an upper end of the right flexible post, with the net held up vertically on the frame only by the left and right flexible posts; and the upper ends of the left and right side flexible posts pulling away from each other to maintain tension in an upper edge of the net extending between the upper left and right corners of the net, and with upper ends of the left and right flexible side posts also pulling upwardly and vertically away from the left and right side posts, to maintain tension in the left and right side edges of the net, respectively.

2. A sports net apparatus, comprising:

a frame including:

left and right flexible posts; left and right side members; and a base member;

the left flexible post having an upper end and a lower end, with the lower end of the left flexible post attached to a left corner fitting at a left end of the base member;

the right flexible post having an upper end and a lower end, with the lower end of the right flexible post attached to a right corner fitting at a right end of the base member;

the left side member having a front end and a back end, with the back end of the left flexible side member attached to the left corner fitting;

the right side member having a front end and a back end, with the back end of the right side member attached to the right corner fitting; and a net including:

a lower left corner attached to the front end of the left side member;

a lower right corner attached to the front end of the right side member;

an upper left corner attached to an upper end of the left flexible post;

an upper right corner attached to an upper end of the right flexible post; and the upper ends of the left and right side flexible posts biased away from each other to maintain tension in an upper edge of the net, and also biased upwardly to maintain tension in left and right side edges of the net, with the upper left and right corners of the net in front of the left and right corner fittings, respectively, and with the net held up by the frame only with left and right flexible posts.

3. The sports net apparatus of claim 2 with the left and right corner fittings each having receptacles oriented on a lateral axis, a longitudinal axis and on a vertical axis, and with the lateral axis substantially perpendicular to the longitudinal axis, and with the vertical axis at an obtuse angle to the lateral axis.

4. The sports net apparatus of claim 2 with the net having flexible left edge, right edge and top edge strips and with the upper ends of left and right flexible posts exerting spring force up and away from each other, tensioning the left edge, right edge and top edge strips of the net.

5. The sports net apparatus of claim 4 further comprising left and right lower attachment fittings on the left and right edge strips at the lower left and right corners of the net, with the left and right lower attachment fittings adapted to attach to the front ends of the left and right side members, respectively.

6. The sports net apparatus of claim 3 with the lateral, longitudinal and vertical axes intersecting at a common intersection point.

7. The sports net apparatus of claim 2 wherein the base member is flexible and curves upwardly from its ends towards its center, before the net is attached to the frame, and wherein the base member is substantially straight after the net is attached to the frame.

8. The sports net apparatus of claim 2 with the flexible posts substantially straight when the net is not attached to the posts.

9. The sports net apparatus of claim 2 with the net releasably attachable to and removable from the frame, by hand.

10. A sports net apparatus, comprising:

a frame including:

left and right flexible posts; left and right side members; and a base member;

the left flexible post having an upper end and a lower end, with the lower end of the left flexible post attached to a left corner fitting at a left end of the base member;

the right flexible post having an upper end and a lower end, with the lower end of the right flexible post attached to a right corner fitting at a right end of the base member;

the left side member having a front end and a back end, with the back end of the left flexible side member attached to the left corner fitting;

with the left and right corner fittings each having receptacles oriented on a lateral axis, a longitudinal axis and on a vertical axis, and with the lateral axis substantially perpendicular to the longitudinal axis, and with the vertical axis at an obtuse angle to the lateral axis, with the lateral, longitudinal and vertical axes intersecting at a common intersection point;

the right side member having a front end and a back end, with the back end of the right side member attached to the right corner fitting; and a net including:

a lower left corner attached to the front end of the left side member;

a lower right corner attached to the front end of the right side member;

an upper left corner attached to an upper end of the left flexible post;

an upper right corner attached to an upper end of the right flexible post;

the upper ends of the left and right side flexible posts biased away from each other to maintain tension in an upper edge of the net, and also biased upwardly to maintain tension in left and right side edges of the net, the upper left and right corners of the net in front of the left and right corner fittings, respectively.

11. A sports net apparatus, comprising:

a frame and a net, the frame including:

left and right flexible posts; left and right side members; and a base member;

the left flexible post having an upper end and a lower end, with the lower end of the left flexible post attached to a left corner fitting at a left end of the base member;

the right flexible post having an upper end and a lower end, with the lower end of the right flexible post attached to a right corner fitting at a right end of the base member;

the left side member having a front end and a back end, with the back end of the left flexible side member attached to the left corner fitting;

the right side member having a front end and a back end, with the back end of the right side member attached to the right corner fitting;

wherein the base member is flexible and curves upwardly from its ends towards its center, before the net is attached to the frame, and wherein the base member is substantially straight after the net is attached to the frame; and the net including:

a lower left corner attached to the front end of the left side member;

a lower right corner attached to the front end of the right side member;

an upper left corner attached to an upper end of the left flexible post;

an upper right corner attached to an upper end of the right flexible post; and the upper ends of the left and right side flexible posts biased away from each other to maintain tension in an upper edge of the net, and also biased upwardly to maintain tension in left and right side edges of the net, and with the upper left and right corners of the net in front of the left and right corner fittings, respectively.

12. The sports net apparatus of claim 11 with the net held up by the frame only with left and right flexible posts.

* * * * *